US005800220A

United States Patent [19]

Feeny et al.

[11] Patent Number: 5,800,220

[45] Date of Patent: Sep. 1, 1998

[54] TAB RECEPTACLE TERMINAL

[75] Inventors: John V. Feeny, Livonia, Mich.; Jeffery A. Kocinski, Valley View, Ohio; Robert J. Cue, South Lyon, Mich.

[73] Assignee: Framatome Connectors Interlock Inc., Norwalk, Conn.

[21] Appl. No.: 735,679

[22] Filed: Oct. 23, 1996

Related U.S. Application Data

[60] Provisional application No. 60/006,115 Oct. 23, 1995.

[51] Int. Cl.[6] ..... H01R 11/22; H01R 13/11; H01R 15/10

[52] U.S. Cl. ..... 439/849; 439/851; 439/948

[58] Field of Search ..... 439/845, 849, 439/850, 948, 851, 852

[56] References Cited

U.S. PATENT DOCUMENTS

| | | | |
|---|---|---|---|
| 2,791,755 | 5/1957 | Hammell | 439/849 |
| 3,550,069 | 12/1970 | Teagno | 439/849 |
| 3,644,872 | 2/1972 | Russo, Jr. | 439/849 |
| 4,423,921 | 1/1984 | Hall | 439/849 |
| 4,696,530 | 9/1987 | Vandame | 439/849 |
| 4,713,026 | 12/1987 | Mobley et al. . | |
| 5,269,712 | 12/1993 | Denlinger et al. | 439/845 |
| 5,427,552 | 6/1995 | Zielinski et al. | 439/849 |

FOREIGN PATENT DOCUMENTS

| | | | |
|---|---|---|---|
| 0001159 | 3/1979 | European Pat. Off. | 439/849 |
| 1309769 | 3/1973 | United Kingdom | 439/849 |

*Primary Examiner*—Neil Abrams
*Assistant Examiner*—Katrina Davis
*Attorney, Agent, or Firm*—Harness, Dickey & Pierce, P.L.C.

[57] ABSTRACT

A tab receptacle terminal fabricated by bending a single sheet of electrically conductive material. The receptacle terminal includes a receptacle box having at one end an opening through which a male terminal can be inserted. A spring is formed in the top of the box so as to extend substantially across the length of the top between the ends of the box. The spring projects interiorly of the box toward its bottom for engagement with an inserted male terminal. Portions of the spring define a leading surface and a trailing surface with the leading surface defining an angle with respect to the top which is greater than an angle defined between the top and the trailing surface. A pair of closed slots extending lengthwise along the top adjacent the juncture of the top with the sides to define the spring.

15 Claims, 4 Drawing Sheets

TAB RECEPTACLE TERMINAL

REFERENCE TO RELATED APPLICATION

This application claims the benefit of U.S. Provisional application Ser. No. 60/006,115, filed Oct. 23, 1995.

BACKGROUND AND SUMMARY OF THE INVENTION

1. Field of the Invention

The present invention generally relates to tab receptacle terminals. More specifically, the present invention relates to an electrical terminal, known as a one piece tab receptacle, designed for high speed, low cost assembly operations with features that allow the terminal to be used in a variety of applications.

2. Description of the Prior Art

Previously, tab terminals have been principally designed with a configuration intended for single use or application. In other words, the tab terminals were intended to be used within a specifically designed plastic connector housing. The housing also operated as the locking mechanism which maintained the tab receptacle on a male tab or blade terminal (hereinafter just "blade terminal"). Manufactured from thin material stock, the terminals were of limited electrical capabilities and therefore limited the entire terminal system.

U.S. Pat. No. 4,713,026, which is herein incorporated by reference, discloses a tab receptacle terminal which provides for improved electrical contact between the tab receptacle terminal and the blade terminal. The tab receptacle terminal of the '026 patent is generally a formed receptacle box with the top of the box configured in the shape of a leaf spring that extends downward toward the bottom of the box. The spring is resiliently movable away from the bottom of the box to permit insertion of a blade terminal and to provide for firm engagement of the blade terminal with beams formed on the opposing side or bottom of the box. Retention between the spring and the blade terminal is provided by projection on the spring. This projection projects toward the bottom of the tab receptacle terminal and engages or drops into a detent or hole formed in the blade terminal. The beams formed on the bottom of the tab receptacle terminal extend upward towards the spring. Accordingly, when a blade terminal is inserted into the tab receptacle terminal, a normal force is applied to the blade terminal by the spring and this forces the blade terminal against the fixed beams resulting in firm electrical contact. To enable the receptacle terminal of the '026 patent to retain its box-like shape, interlocking tabs extend off of the top and one side of the box. The tabs are each returnly bent back over the other of the top and one side. Stabilizing nibs are further formed on the bottom wall of the tab receptacle terminal and the nibs maintain the receptacle terminal in a fixed position within the cavity of the connector housing.

In view of the above, it is a principal object of the present invention to provide an improved tab receptacle terminal which exhibits better spring characteristics including a decreased required insertion force relative to the withdrawal force.

Another object of the present invention to provide a tab receptacle terminal which protects the spring from over-stressing.

A further object of the present invention to provide a tab receptacle terminal which more positively retains a blade terminal in engagement therewith.

It is also an object of the present invention to provide a tab receptacle terminal which accepts a wider variety of blade terminals.

Yet another object of the present invention to provide a tab receptacle terminal which has a more robust construction that decreases the likelihood that the receptacle terminal will be damaged during handling and assembling.

SUMMARY OF THE PRESENT INVENTION

The terminal of the present invention is a one-piece, female, box-style terminal which is often termed as a tab receptacle terminal. Some of the unique features of the present terminal include a spring design that accommodates a wide variation of blade thicknesses and enhances use of the spring, a wall portion which protects the spring from being over stressed and acquiring a permanent set, a locking dimple which enhances the engagement of the receptacle terminal with a blade terminal, and a box interface that provides the receptacle terminal with a more robust construction.

The present terminal has been designed for use in multiple applications. Previously, a terminal would be designed for use with a particular plastic housing or in a discrete application. The terminal of the present invention is designed to readily allow it to be used in a variety of connector housings or in a variety of stand alone applications. The spring design of the present invention is such that it provides the spring with a greater ability to flex, particularly after being mated to a blade terminal. This has several benefits. First, it requires a lower insertion effort to mate the male blade terminal with the receptacle terminal. Second, it allows the receptacle terminal to accept various styles and thicknesses of blades while providing for a more consistent and repeatable insertion effort and engagement. Third, it lessens the likelihood that the spring of the receptacle terminal will acquire a mechanical set.

When the receptacle terminal is mated to a blade terminal, the spring will have been deflected an amount due to the thickness of the male terminal. However, once mated to the male terminal, a limited additional amount of deflection, resulting from handling or pulling on the blade terminal, is still permitted to occur. This prevents the over stressing of the spring and the inducing of a set in the spring. If a set were to develop in the spring, that condition would cause a loss in the normal force which could be applied by the spring to the blade terminal and that could then result in a loss of electrical capabilities for the terminal assembly.

The present design also incorporates a unique locking dimple design. The dimple, which is formed on the spring, is configured to require a low insertion force when being mated with a blade terminal, but a high removal force.

The interface area of the box design is provided to strengthen the integrity of the terminal's construction. This in turn enables the terminal to withstand rough handling during shipping and assembling operations. The box and interface design also gives the terminal a lower profile and this has proven valuable when designing plastic housings.

Dual locking windows are formed in the receptacle terminal to allow the terminal to be used in either stand alone applications or in a discrete plastic connector housing. Use of dual windows also enables the receptacle terminal to be non-orientation specific when being inserted into a plastic connector housing. In other words, the receptacle terminal can be inserted into a connector housing right side up or upside down.

In an alternative embodiment, the leading edges on the sides of the forward end of the receptacle terminal, namely those edges adjacent to the blade insertion opening, are recessed or provided with cut-outs. The cut-outs allow the tab receptacle terminal to receive a blade terminal configured with shoulders that are wider than the blade portion itself.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENTS

Figure 1:
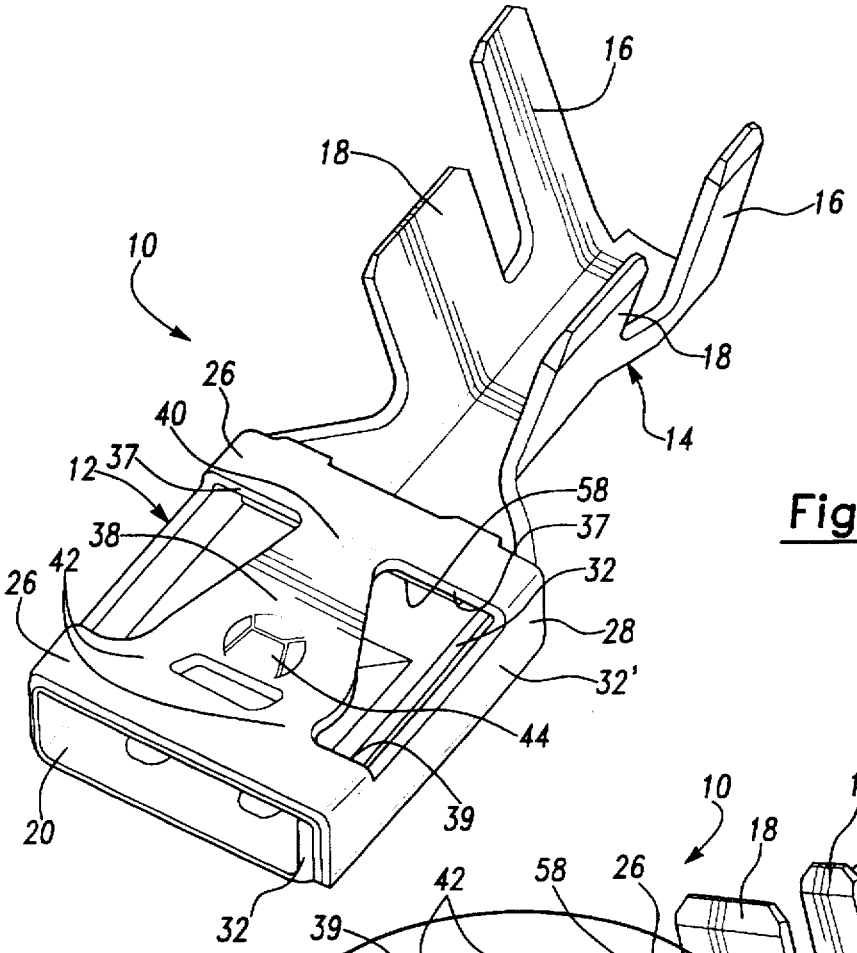
FIG. 1 is a perspective view of a receptacle terminal embodying the principles of the present invention.
Figure 2:
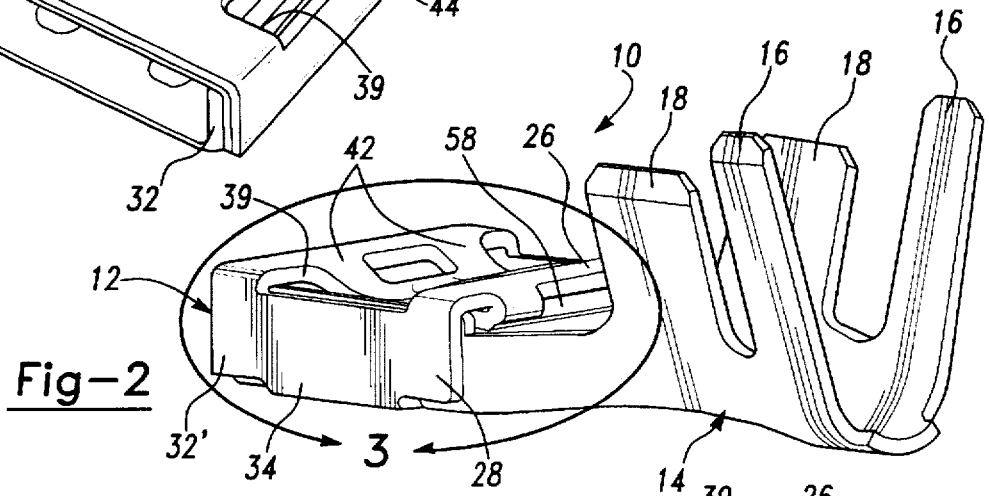
FIG. 2 is a generally rearward perspective view of the receptacle terminal illustrated in FIG. 1.
Figure 3:
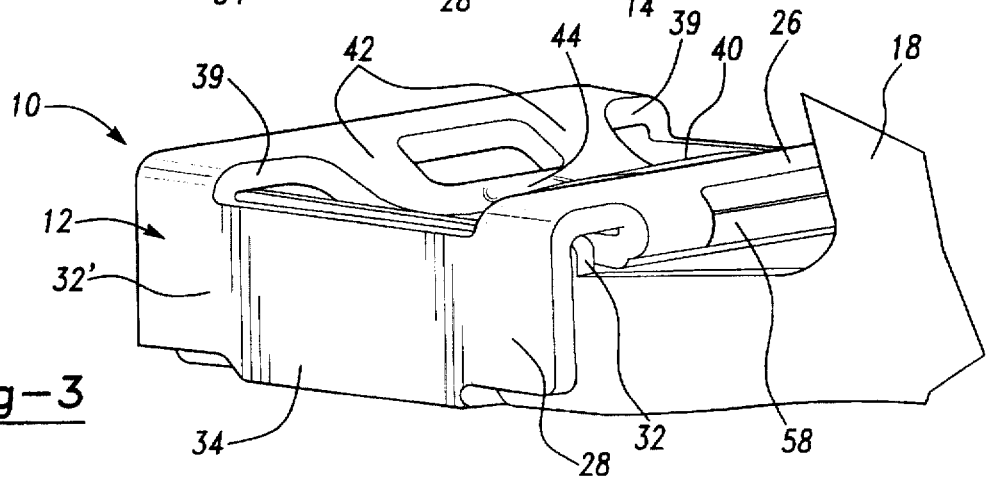
FIG. 3 is an enlarged perspective view of the portion enclosed within circle 3 of FIG. 2.
Figure 4:
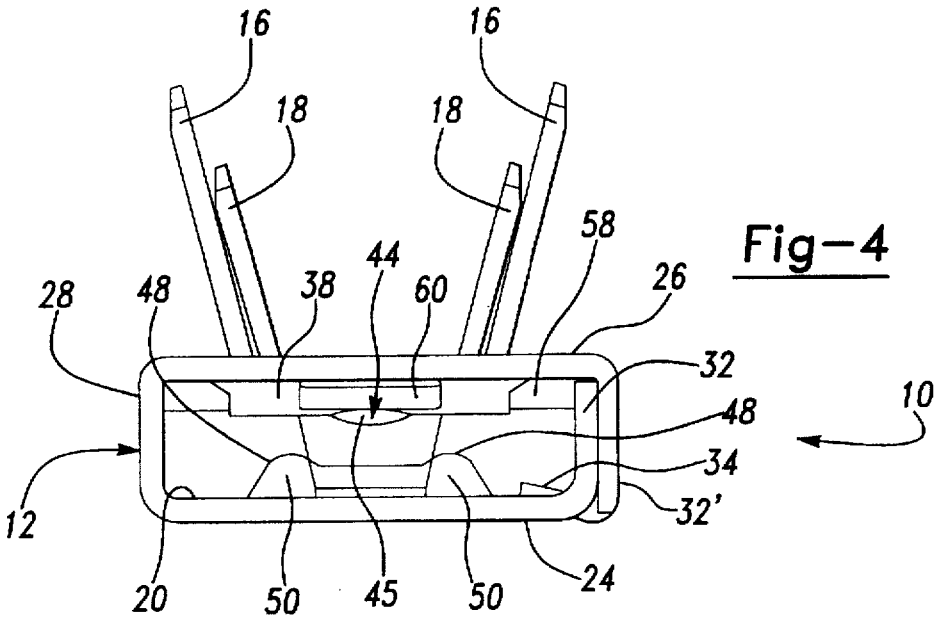
FIG. 4 is an insertion end view of the receptacle terminal seen in FIG. 1.
Figure 5:
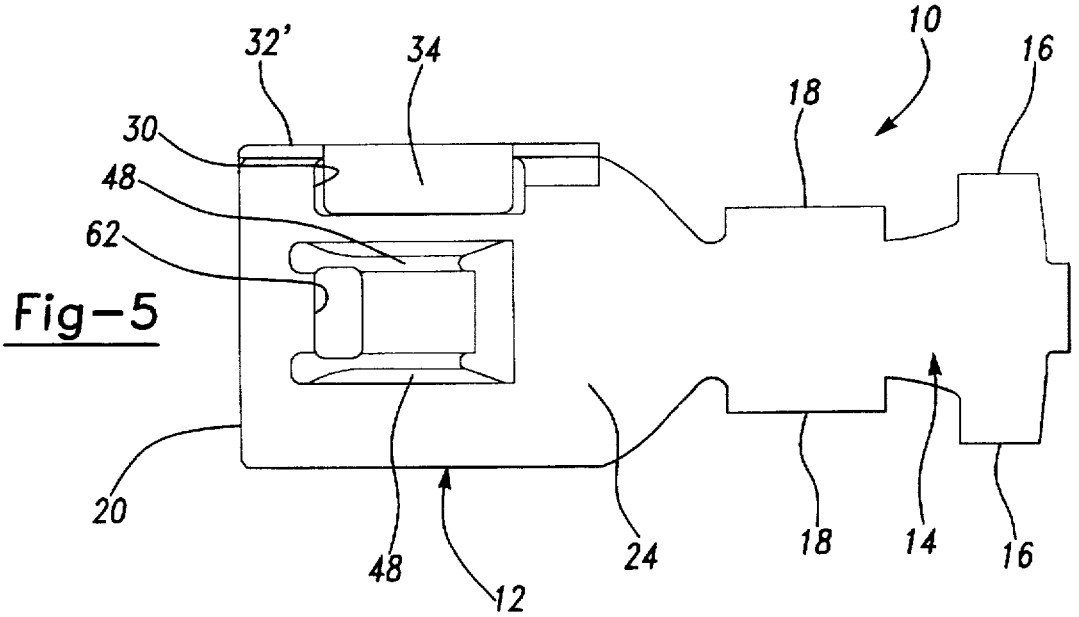
FIG. 5 is a bottom view of the receptacle terminal illustrated in FIG. 1.
Figure 6:
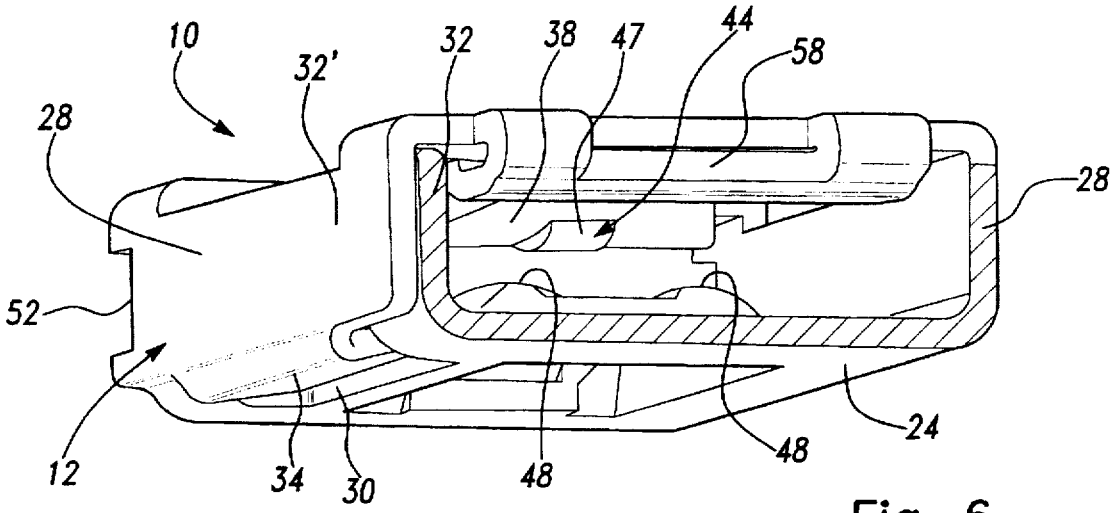
FIG. 6 is a rear-bottom perspective view with portions broken away illustrating various internal features of the receptacle terminal and an alternative dimple configuration.
Figure 7:
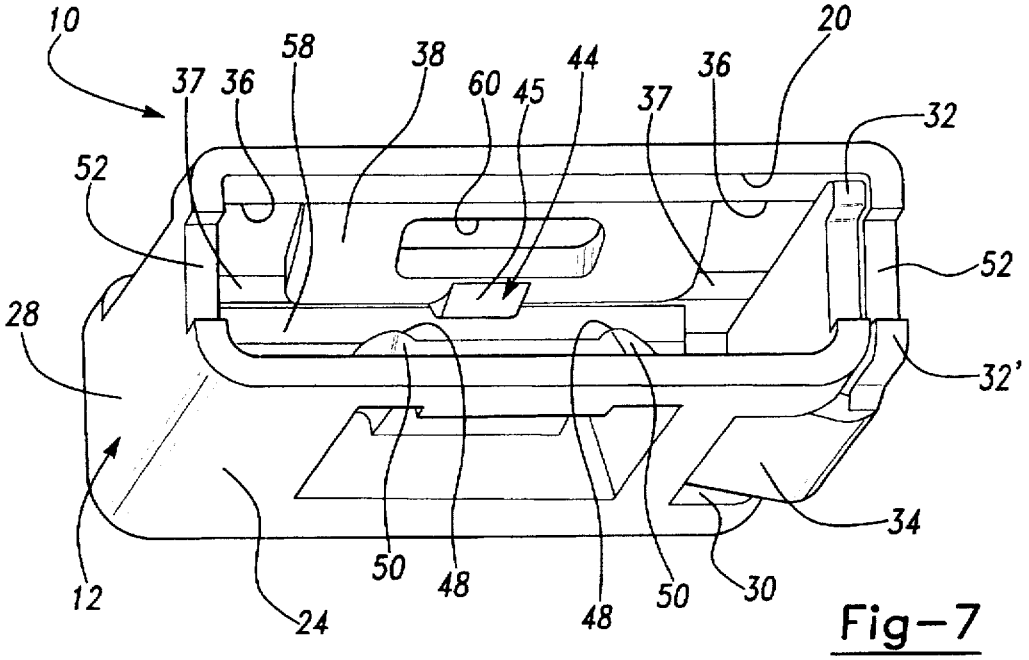
FIG. 7 is a front-bottom perspective view of a portion of the tab receptacle terminal seen in FIG. 6.

Referring now to the drawings, a tab receptacle terminal embodying the principles of the present invention is generally illustrated in FIG. 1 and designated at 10. As seen therein, the tab receptacle terminal 10 (hereinafter just "terminal 10") is formed from a single sheet of electrically conductive metal which is bent to form the terminal 10. As formed, the terminal 10 is principally comprised of a receptacle box 12 and a conductor gripping section 14.

The conductor gripping section 14 is conventional in design and includes a first pair of tabs 16 which are crimped into engagement with the insulation surrounding the conductor (not shown) and a second pair of tabs 18 which are crimped into engagement with the conductor itself.

The receptacle box 12 (hereinafter just "box 12") is generally rectangular in shape having an insertion end, opposite the conductor gripping portion 14, with an opening 20 through which a male terminal 22 can be inserted to make contact with the box 12. The walls of the box 12 are defined by a bottom 24, a top 26 and sides 28.

To form and retain the box 12 in its rectangular, box-like shape, a cut-out 30 is defined in that portion of the metal which subsequently forms the bottom 24 of the box 12. The cut-out 30 is located adjacent to overlapping wall portions 32 and 32' which cooperate to define one side 28 of the receptacle box 12. The outboard overlapping wall portion 32' extends downward from the top 26 and has a lock tab 34 extending off of its lower end. In the finally formed terminal 10, the lock tab 34 is bent to extend below and around the inboard overlapping wall portion 32 and up into the cut-out 30. By bending the lock tab 34 in this fashion and overlapping the wall portions 32 and 32', the box 12 is locked into its rectangular box-like configuration and is provided with a robust construction that enables the box 12 to withstand rough handling during shipping and assembly.

In the top 26 of the box 12, metal is isolated by forming lengthwise slots 36 generally at the juncture at the top 26 and the sides 28. The shape of the slots 36 is such that the rear portion 37 of the slots 36 is wider than the front portions 39 of the slots 36. This results in the isolated metal being connected to the rear portion of the top 26 at a narrow transition 40 in comparison to the forward transition 42, where the isolated metal connects to the front portion of the top 26.

Figure 8:
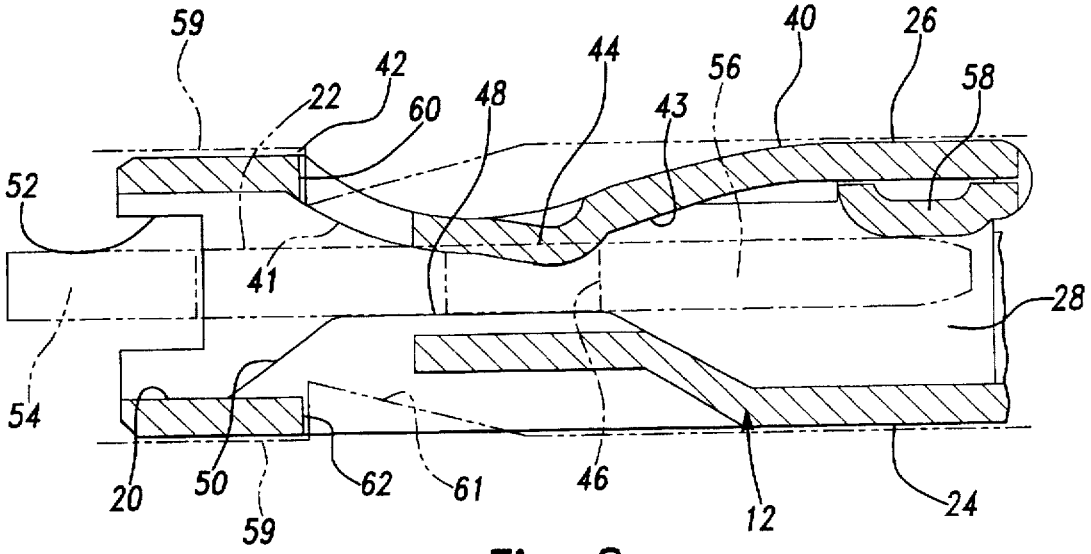
FIG. 8 is a longitudinal sectional view of a tab receptacle embodying the principles of the present invention having a blade terminal inserted thereinto.

The isolated metal in the top 26 is formed so as to project toward the bottom 24 of the box 12 and operate as a leaf spring 38. The spring 38 is also shaped to define leading and trailing surfaces 41, 43 which are set at differing angles with respect to the box 12. The angle of the lead surface 41 results in the lead surface being steeper than the trailing surface 43 (as perhaps best seen in FIGS. 8 and 9). The relative angling of the leading and trailing surfaces 41, 43 in conjunction with the narrow and wide transitions 40, 42 of the spring 38, result in the spring 38 exerting a lesser normal force during insertion over withdrawal of a blade terminal 22.

Formed on the spring 38, generally at a position where the spring 38 is closest to the bottom 24 of the box 12, is a dimple 44, formed as a displaced or upset portion of the spring 38. The dimple 44 projects from the surface of the spring 38 and is intended to engage a slot or cut-out 46 formed in the blade terminal 22, such as a standard 0.250 "ANSI/NEMA" blade with either a hole or detent for the dimple 44 to drop into. As with the spring 38, the dimple 44 also exhibits leading and trailing surfaces 45, 47. However, the trailing surface 47 of the dimple 44 is steeper than the leading surface 45 which is formed with a blended radius or merger into the spring 38 for a smooth lead-in. The trailing surface 47 has a defined edge to "grab" the blade terminal 22. As a result, when engaged with a blade terminal 22, the dimple 44, in conjunction with the spring 38, results in an increase withdrawal force being required over the insertion force without resulting in the dimple 44 begin destroyed after repeated engagement disengagement. In the embodiment seen in FIGS. 14, the dimple 44 is defined by a generally rounded perimeter. In FIGS. 6–9, the perimeter of the dimple 44 is defined by a rectangular or elongated shape. Alternative perimeter shapes for the dimple 44, such as pentagonal, trapezoidal, triangular, etc., could be utilized so long as the above discussed leading and trailing surface 45, 47 features are retained.

A portion of the bottom 24 is formed to define a pair of raised, generally longitudinally extending beams 48. The beams 48 project from the bottom 24 generally toward the top 26 and the spring 38 of the box 12. When a blade terminal 22 is inserted into the box 12, the normal force exerted by the spring 38 biases the blade terminal 22 into intimate contact with the beams 48. Each beam 48 is additionally formed at its lead end, the end adjacent to the opening 20 of the box 12, with a ramp surface 50. The ramp surfaces 50 facilitate insertion of the blade terminal 22 into the box 12. During insertion, the blade terminal 22 first engages the ramp surfaces 50 and rides up onto the beams 48, where further insertion results in the blade terminal 22 being contacted on one side by the beams 48 and on the opposing side by the spring 38.

In an alternative embodiment of the present invention (seen in FIGS. 6, 7, 8 and 9), recesses 52 are defined in the sides 28 adjacent to the opening 20 into the box 12. The recesses 52 enable the terminal 10 to more fully receive thereinto a blade terminal 22 having shoulders 54 which are wider than its blade portion 56.

Figure 9:
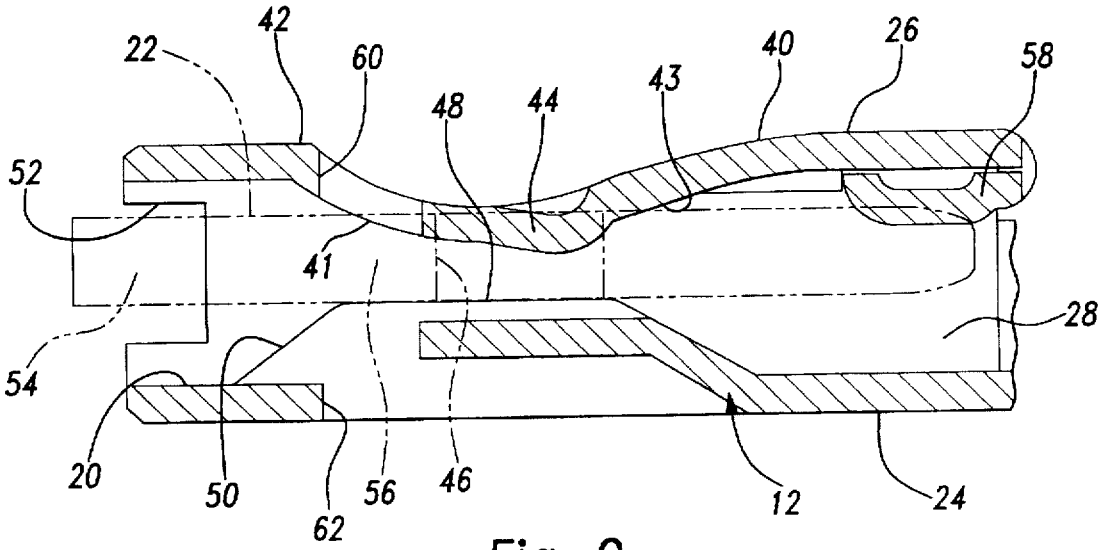
FIG. 9 is a longitudinal sectional view similar to FIG. 8 illustrating the spring protection feature of the present invention full insertion of a male terminal thereinto.

To prevent overstressing of the spring 38 and the possibility of the spring 38 acquiring a mechanical set, the box 12 is formed with an anti-overstressing or spring protection tab 58. This tab 58 prevents male terminals 22 having a blade 56 thickness which is too excessive for the box 12 from being fully inserted into the box 12. While the tab 58 can be provided in a variety of configurations, as illustrated herein the tab 58 is provided in the form of a doubled over or reversely bent portion of the top 26 adjacent to the rear end of the box 12. The thickness defined by the tab 58 operates as an obstruction within the box 12 which will prevent the full insertion of a blade terminal 22 having a thickness which is greater than the resilient capabilities of the spring 38. Such a male terminal is illustrated in FIG. 9. This tab 58 also prevents overstressing of the spring 38 when an acceptably sized blade terminal 22 is moved, shifted, pulled-on or otherwise manipulated during assembly or use of the terminal 10.

Another feature of the terminal 10 of the present invention is its non-orientation specific design and construction. To facilitate the retainment of the terminal 10 with a connector housing 59 (shown in phantom in FIG. 8), upper and lower windows, respectively 60, 62, are formed in the top 26 and bottom 24 of the box 12. The windows 60, 62, generally oppose one another and allow shoulders 61, formed with the connector housing 59, to engage the terminal 10 regardless of whether the terminal 10 is inserted rightside up or upside down. Accordingly, the terminal 10 of the present invention will allow for faster and less costly installation of the terminal 10 into the connector housing 59.

While the above description constitutes the preferred embodiment of the present invention, it will be appreciated that the invention is susceptible to modification, variation and change without departing from the proper scope and fair meaning of the accompanying claims.

We claim:

1. A tab receptacle terminal fabricated by bending a single sheet of electrically conductive material, said receptacle terminal comprising:

a receptacle box having a closed continuous wall defining at one end and an opening through which a male terminal is inserted so as to make contact with said box, said box including a bottom, a top, and sides;

spring means formed in said top so as to extend substantially across the length of said top between said one end and an opposing end of said box, said spring means projecting interiorly of said box toward said bottom for engagement with an inserted male terminal within said box, said spring means having portions defining a leading surface and a trailing surface thereon, said leading surface defining an angle with respect to said top which is greater than an angle defined between said top and said trailing surface;

retention means for retaining the male terminal, said retention means providing a retention force against withdrawal of an inserted male terminal, said retention force being greater than an insertion force provided by said retention means to engage with said retention means; and a pair of closed slots extending lengthwise along said top adjacent a juncture of said top with said sides to define said spring means and enable deflection of said spring means.

2. A tab receptacle terminal as set forth in claim 1 wherein said retention means includes a projection formed on said spring means, said projection extending from said spring means toward said bottom to engage the male terminal inserted into said receptacle terminal.

3. A tab receptacle terminal as set forth in claim 2 wherein said projection is a non-deflectable member formed in said spring means.

4. A tab receptacle terminal as set forth in claim 2 wherein said projection includes portions defining a leading surface and a trailing surface, said trailing surface defining a greater angle with respect to said top than an angle defined between said top and said leading surface.

5. A tab receptacle terminal as set forth in claim 1 wherein said spring means is a leaf spring.

6. A tab receptacle terminal as set forth in claim 1 wherein said slots having a first width adjacent to said end opening and a second width adjacent to said opposing end providing said spring means with an increased width at a transition from said spring means to said top adjacent to said end opening and a lesser width at a transition from said spring means to said top adjacent to said opposing end.

7. A tab receptacle terminal as set forth in claim 1 further comprising preventative means for limiting deflection of said spring means.

8. A tab receptacle terminal as set forth in claim 7 wherein said preventative means includes a wall portion projecting from said top interiorly of said box and defining a reduced height within a portion of said box between said top and bottom.

9. A tab receptacle terminal fabricated by bending a single sheet of electrically conductive material, said receptacle terminal comprising:

a receptacle box having a closed continuous wall defining at one end and an opening through which a male terminal is inserted so as to make contact with said box, said box including a bottom, a top, and sides;

spring means formed in said top so as to extend substantially across the length of said too between said one end and an opposing end of said box, said spring means projecting interiorly of said box toward said bottom for engagement with an inserted male terminal within said box, said spring means having portions defining a leading surface and a trailing surface thereon, said leading surface defining an angle with respect to said top which is greater than an angle defined between said top and said trailing surface;

retention means for retaining the male terminal, said retention means providing a retention force against withdrawal of an inserted male terminal, said retention force being greater than an insertion force provided by said retention means to engage with said retention means;

a pair of closed slots extending lengthwise along said top adjacent a juncture of said top with said sides to define said spring means and enable deflection of said spring means; and preventative means for limiting deflection of said spring means, said preventative means including a wall portion projecting from said top interiorly of said box and defining a reduced height within a portion of said box between said top and bottom, said wall portion being a portion of said top bent upon itself to define the reduced height within said box.

10. A tab receptacle terminal as set forth in claim 8 wherein said wall portion is a portion of said top adjacent to said opposing end of said box.

11. A tab receptacle terminal fabricated by bending a single sheet of electrically conductive material, said receptacle terminal comprising:

a receptacle box having a closed continuous wall defining at one end and an opening through which a male terminal is inserted so as to make contact with said box, said box including a bottom, a top, and sides;

spring means formed in said top so as to extend substantially across the length of said top between said one end and an opposing end of said box, said spring means projecting interiorly of said box toward said bottom for engagement with an inserted male terminal within said box, said spring means having portions defining a leading surface and a trailing surface thereon, said leading surface defining an angle with respect to said top which is greater than an angle defined between said top and said trailing surface;

retention means for retaining the male terminal, said retention means providing a retention force against withdrawal of an inserted male terminal, said retention force being greater than an insertion force provided by said retention means to engage with said retention means;

a pair of closed slots extending lengthwise along said top adjacent a juncture of said top with said sides to define said spring means and enable deflection of said spring means; and recesses being defined by portions of said sides adjacent to said end opening to receive therein a wider portion of the male terminal than a portion of the male terminal inserted into said box.

12. A tab receptacle terminal as set forth in claim 1 wherein said one of said sides of said box includes a pair of overlapping side wall portions, one of said overlapping side wall portions extending upward from said bottom and another of said overlapping side wall portions extending downward from said top.

13. A tab receptacle terminal as set forth in claim 12 wherein one of said overlapping side wall portions includes a tab extending therefrom, said tab being folded about the other of said overlapping side wall portions to secure said box in its box shape.

14. A tab receptacle terminal as set forth in claim 13 wherein said tab is folded about the other of said overlapping side wall portions and into an opening defined in one of said top and bottom thereby securing said box in its box shape.

15. A tab receptacle terminal as set forth in claim 14 wherein said opening is defined in said bottom of said box.

* * * * *